US009773624B2

(12) United States Patent
Maloney et al.

(10) Patent No.: US 9,773,624 B2
(45) Date of Patent: Sep. 26, 2017

(54) ELECTRICAL SWITCHING APPARATUS AND HOUSING ASSEMBLY THEREFOR

(71) Applicant: EATON CORPORATION, Cleveland, OH (US)

(72) Inventors: James Gerard Maloney, Industry, PA (US); John Thomas Clark, Kersey, PA (US)

(73) Assignee: EATON CORPORATION, Cleveland, OH (US)

( * ) Notice: Subject to any disclaimer, the term of this patent is extended or adjusted under 35 U.S.C. 154(b) by 84 days.

(21) Appl. No.: 14/810,602

(22) Filed: Jul. 28, 2015

(65) Prior Publication Data

US 2017/0032902 A1 Feb. 2, 2017

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/34*** | (2006.01) |
| ***H01H 71/02*** | (2006.01) |

(52) U.S. Cl.
CPC ..... *H01H 9/02* (2013.01); *H01H 9/345* (2013.01); *H01H 71/02* (2013.01)

(58) Field of Classification Search
CPC ..... H01H 9/02; H01H 9/345
See application file for complete search history.

(56) References Cited

U.S. PATENT DOCUMENTS

| | | | | |
|---|---|---|---|---|
| 5,278,531 | A | 1/1994 | Link et al. | |
| 5,436,604 | A | 7/1995 | Mrenna et al. | |
| 5,510,759 | A | 4/1996 | Gula et al. | |
| 6,052,047 | A * | 4/2000 | Malingowski ..... | H01H 71/0228 335/202 |
| 6,060,674 | A * | 5/2000 | Malingowski ..... | H01H 77/108 200/272 |
| 6,104,265 | A | 8/2000 | Maloney et al. | |
| 7,280,018 | B2 * | 10/2007 | Mueller ..... | H01H 71/0257 200/303 |
| 7,569,784 | B2 | 8/2009 | Rakus et al. | |

* cited by examiner

*Primary Examiner* — Renee Luebke
*Assistant Examiner* — Lheiren Mae A Caroc
(74) *Attorney, Agent, or Firm* — Eckert Seamans; John Powers; Grant Coffield

(57) ABSTRACT

A housing assembly is for an electrical switching apparatus. The electrical switching apparatus includes an arc chute and a collar. The housing assembly comprises: a plurality of housing members comprising a first base member and a second base member, the first base member being structured to receive the collar, the second base member being coupled to the first base member and being structured to receive the arc chute. The first base member is made from a first material and the second base member is made from a second, different material.

19 Claims, 6 Drawing Sheets

ELECTRICAL SWITCHING APPARATUS AND HOUSING ASSEMBLY THEREFOR

BACKGROUND

Field

The disclosed concept relates to electrical switching apparatus, such as, for example, circuit breakers. The disclosed concept also relates to housing assemblies for circuit breakers.

Background Information

Electrical switching apparatus include, for example, circuit switching devices; circuit interrupters, such as circuit breakers; network protectors; contactors; motor starters; motor controllers; and other load controllers. Circuit breakers are used to protect electrical circuitry from damage due to an overcurrent condition, such as an overload condition or a relatively high level short circuit or fault condition.

For small power switches, which are commonly referred to as miniature circuit breakers, and which are used, for example, in residential and light commercial electrical distribution systems, the connector assembly for electrically connecting the power conductor of the miniature circuit breaker to the electrical conductors (e.g., without limitation, wires; cables) of the distribution system typically includes a collar terminal. Specifically, for example, the power conductor of the miniature circuit breaker is a relatively rigid, flat conductor, and the collar terminal generally includes a cylindrical or square body having a transverse slot in which the flat power conductor of the circuit breaker and the wire or cable are received, and a tapped bore into which a terminal screw is threaded to clamp the wire or cable against the power conductor and to secure the collar to the power conductor. Typically, the collar is disposed in a recess at a corresponding end of the circuit breaker molded housing. Because tightening the terminal screw of the collar places relatively large amounts of torque on the housing, it is necessary for the housing to be strong.

Additionally, circuit breakers typically include a set of separable electrical contacts. The separable electrical contacts are in physical and electrical contact with one another when it is desired that the circuit breaker energize a power circuit. When it is desired to interrupt separable electrical contacts, an electrical arc is formed in the space between the contacts. The arc provides a means for smoothly transitioning from a closed circuit to an open circuit, but needs to be properly extinguished. In order for the circuit breaker to be properly certified, such as, for example and without limitation, to be properly certified by Underwriters Laboratories Inc., headquartered in Northbrook, Ill., the circuit breaker must be able to interrupt predetermined currents without failing. During the testing, it is critical that the housing of the circuit breaker have good gassing characteristics in order to be able to properly extinguish the arc.

Some known housing materials have the requisite strength to be able to withstand the torque that results from tightening and loosening the terminal screw of the collar, but lack the necessary gassing characteristics to effectively extinguish the arc. Other known housing materials have the necessary gassing characteristics to extinguish the arc, but lack the requisite strength to be able to withstand the torque that results from tightening and loosening of the terminal screw.

There is thus room for improvement in electrical switching apparatus and in housing assemblies therefor.

SUMMARY

These needs and others are met by embodiments of the disclosed concept, which are directed to an electrical switching apparatus and housing assembly therefor in which a first base member is made from a first material and a second base member is made from a second, different material.

In accordance with one aspect of the disclosed concept, a housing assembly for an electrical switching apparatus is provided. The electrical switching apparatus includes an arc chute and a collar. The housing assembly comprises: a plurality of housing members comprising a first base member and a second base member, the first base member being structured to receive the collar, the second base member being coupled to the first base member and being structured to receive the arc chute. The first base member is made from a first material and the second base member is made from a second, different material.

In accordance with another aspect of the disclosed concept, an electrical switching apparatus comprises: an arc chute; a collar; and a housing assembly comprising: a plurality of housing members comprising a first base member and a second base member, the first base member receiving the collar, the second base member being coupled to the first base member and receiving the arc chute. The first base member is made from a first material and the second base member is made from a second, different material.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, rivets, screws, bolts and the combinations of bolts and nuts (e.g., without limitation, lock nuts) and bolts, washers and nuts.

Figure 1:
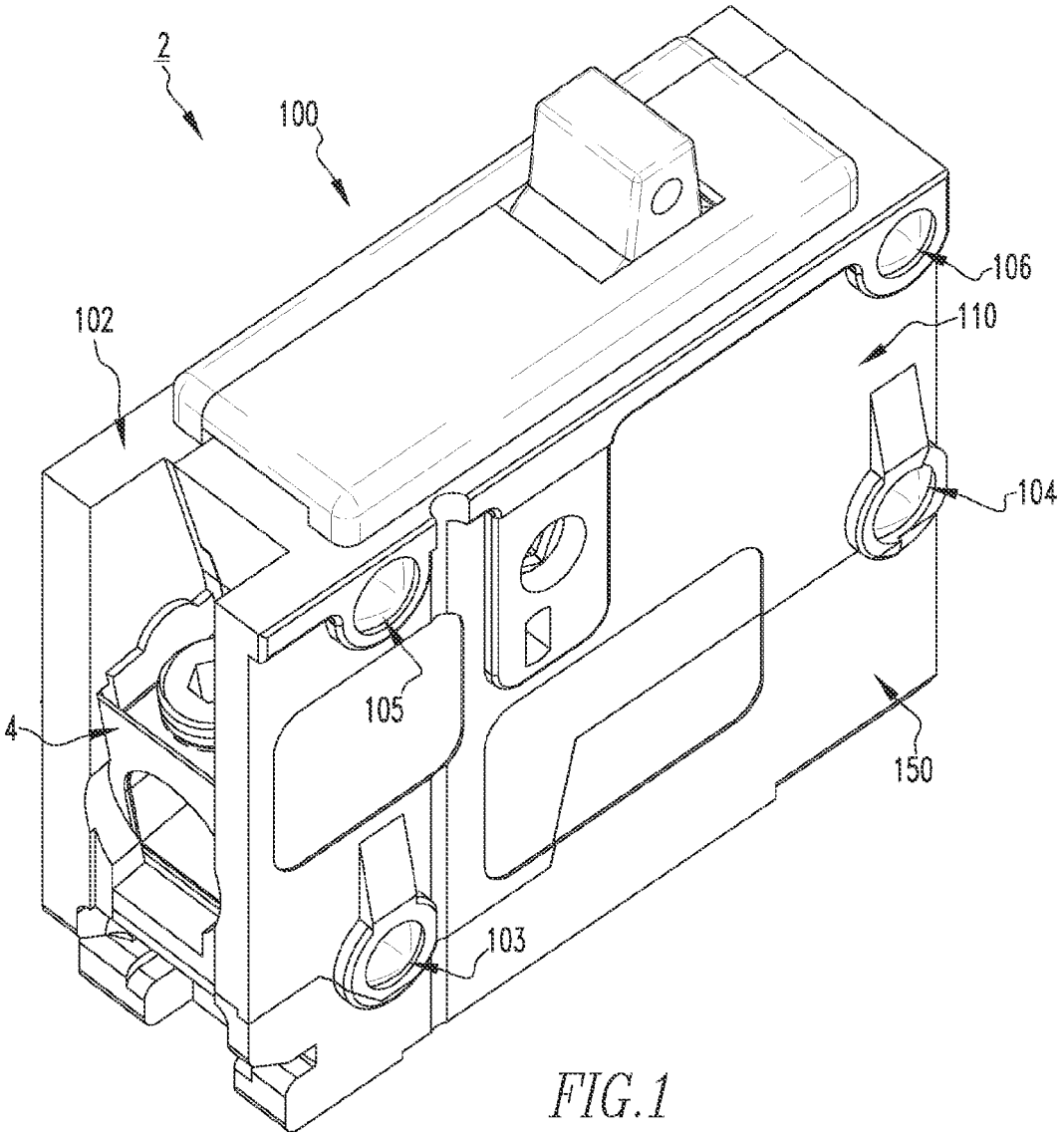
FIG. 1 is an isometric view of an electrical switching apparatus and housing assembly therefor, in accordance with a non-limiting embodiment of the disclosed concept.

FIG. 1 shows a non-limiting example embodiment of an electrical switching apparatus (e.g., without limitation, miniature circuit breaker 2). The example circuit breaker 2 includes a collar 4, an arc chute 6 (shown in simplified form in FIG. 2), and a housing assembly 100. The housing assembly 100 provides structure/support for the collar 4, the arc chute 6 (FIG. 2), and the other main operating components (e.g., the separable contacts/operating mechanism (not shown)) of the circuit breaker 2. As shown in FIG. 3, the housing assembly 100 has a plurality of housing members including a cover 102, a number of coupling members 103,104,105,106, a first base member 110, and a second base member 150. The first base member 110 and the second base member 150 are separate components that are each made from different pieces of material. That is, the first base member 110 and the second base member 150 are not created as a single piece or unit, but rather are created separately as individual pieces and then are coupled together. This is distinct from prior art housing assemblies (not shown), which include a single base member (not shown) that is a unitary component comprised of one single piece of material. As will be discussed in greater detail hereinbelow, the composite nature of the housing assembly 100 (i.e., the separate nature and material properties of the multiple base members 110,150) advantageously allows the circuit breaker 2 to effectively withstand the relatively large amounts of torque that result from tightening and loosening of the collar 4, and simultaneously also effectively extinguish the arc caused by current interruption proximate the arc chute 6. Single-piece designs, on the other hand, tend to be a compromise in that the single piece material can only handle one or the other of these issues well, or must compromise such that the material is subject to undesirable failure or deformation.

Figure 2:
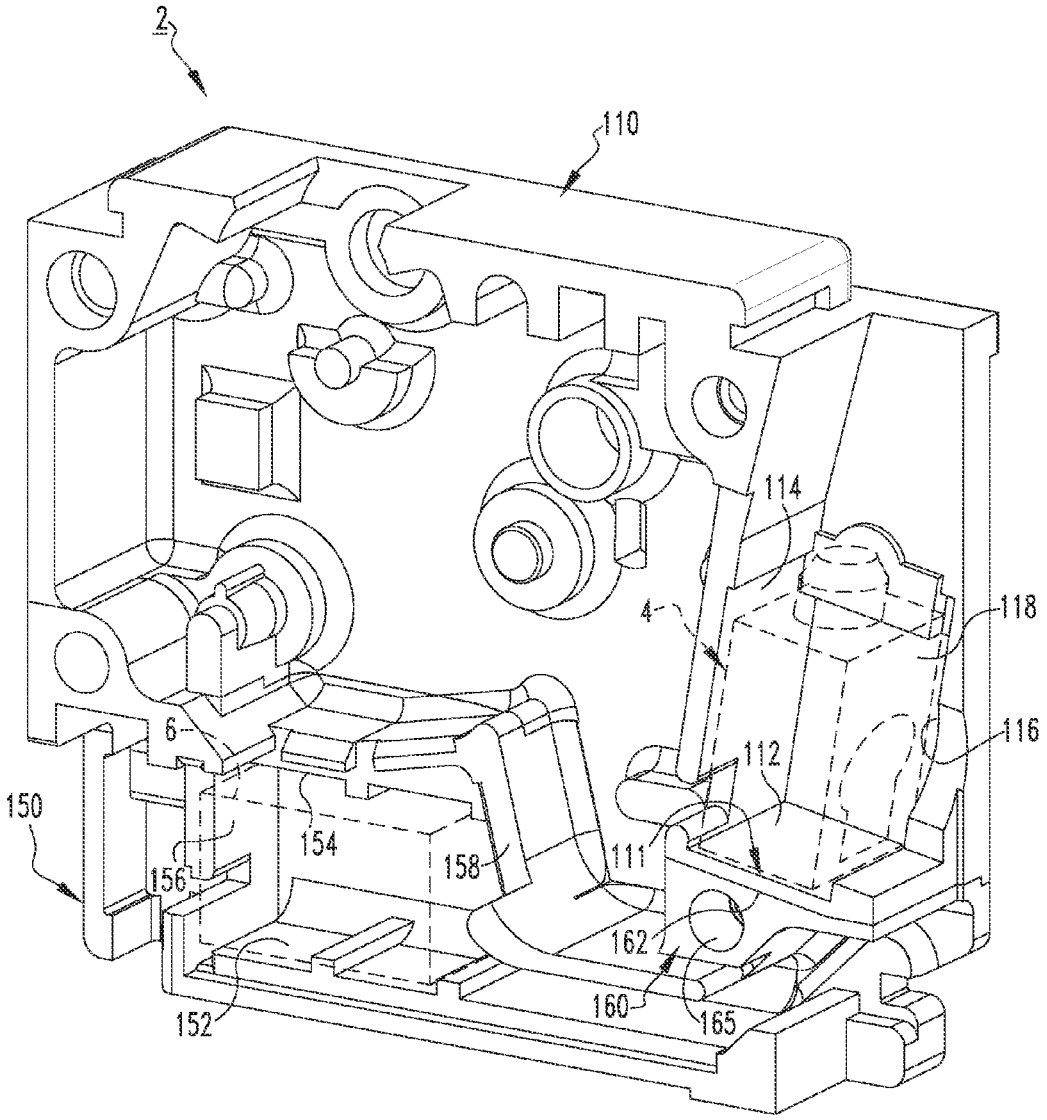
FIG. 2 is an isometric view of the electrical switching apparatus and housing assembly therefor of FIG. 1, partially shown in simplified form, and shown with portions of the housing assembly removed in order to see hidden structures.
Figure 3:
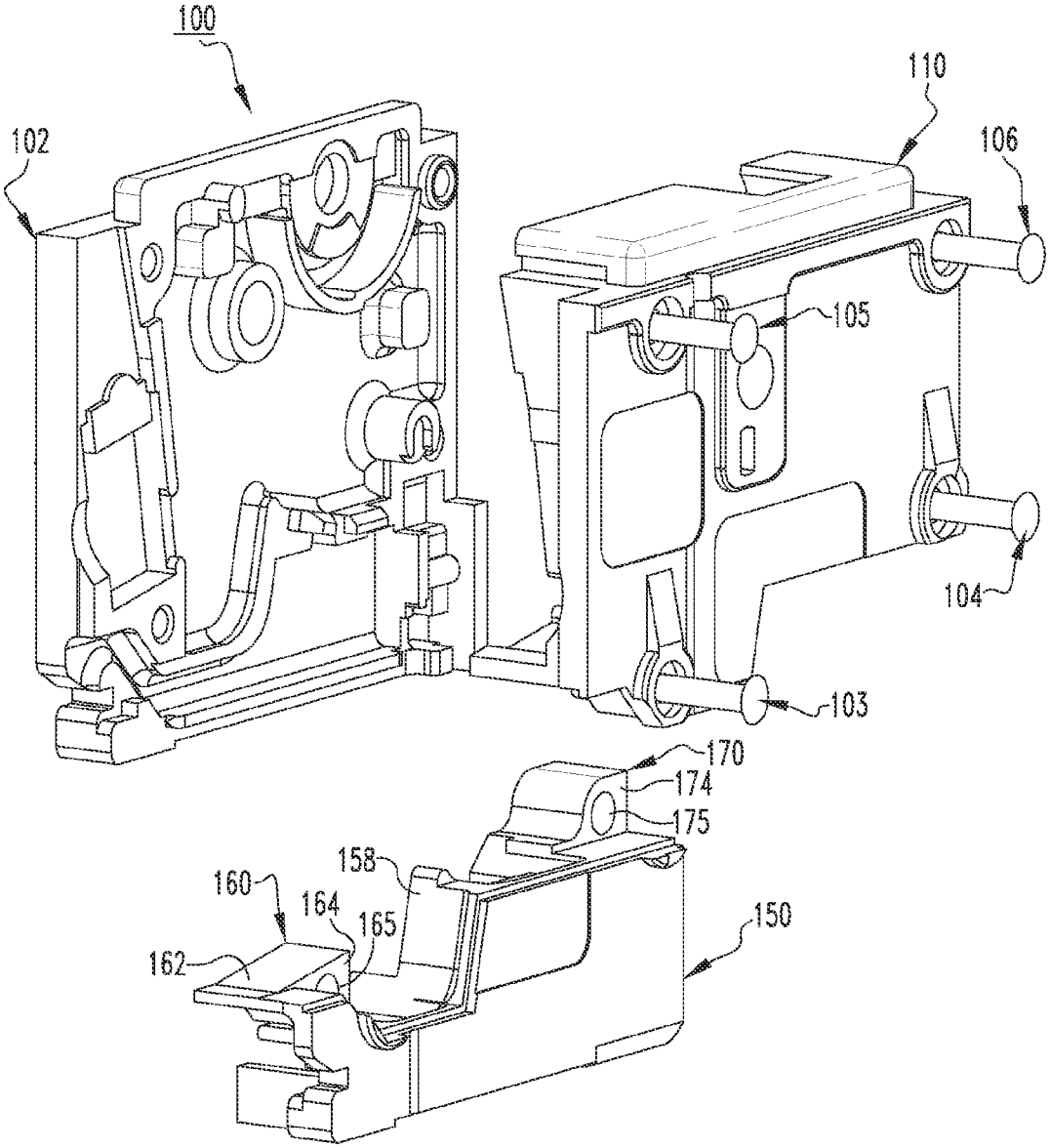
FIG. 3 is an exploded isometric view of the housing assembly of FIG. 1.

Referring to FIG. 2, the first base member 110 receives the collar 4 (shown in simplified form), and the collar 4 is spaced from (i.e., does not engage) the second base member 150. The second base member 150 receives the arc chute 6, and the arc chute 6 is spaced from (i.e., does not engage) the first base member 110.

It will be appreciated with reference to FIG. 3 that the coupling members 103,104 extend through the cover 102, the first base member 110, and the second base member 150 in order to couple the cover 102, the first base member 110, and the second base member 150 together. Additionally, the coupling members 105,106 extend through the cover 102 and the first base member 110 in order to further couple the cover 102 to the first base member 110. In this manner, the coupling members 103,104,105,106 advantageously allow the cover 102, the first base member 110, and the second base member 150 to provide structure/support for the main operating components of the circuit breaker 2 (e.g., the collar 4, the arc chute 6, and the separable contacts/operating mechanism (not shown)).

Figure 4:
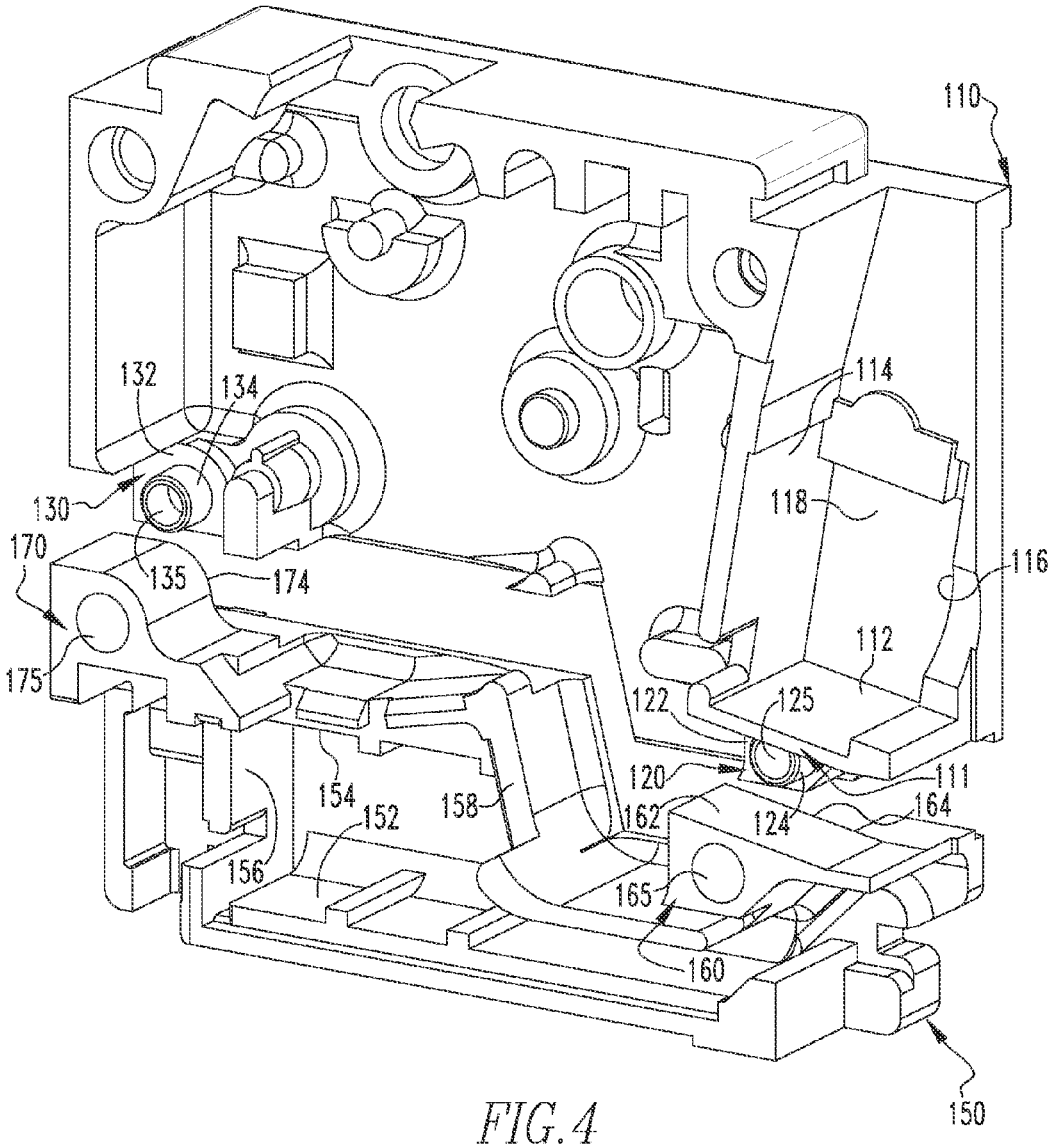
FIG. 4 is an exploded isometric view of a portion of the housing assembly of FIG. 1.
Figure 7:
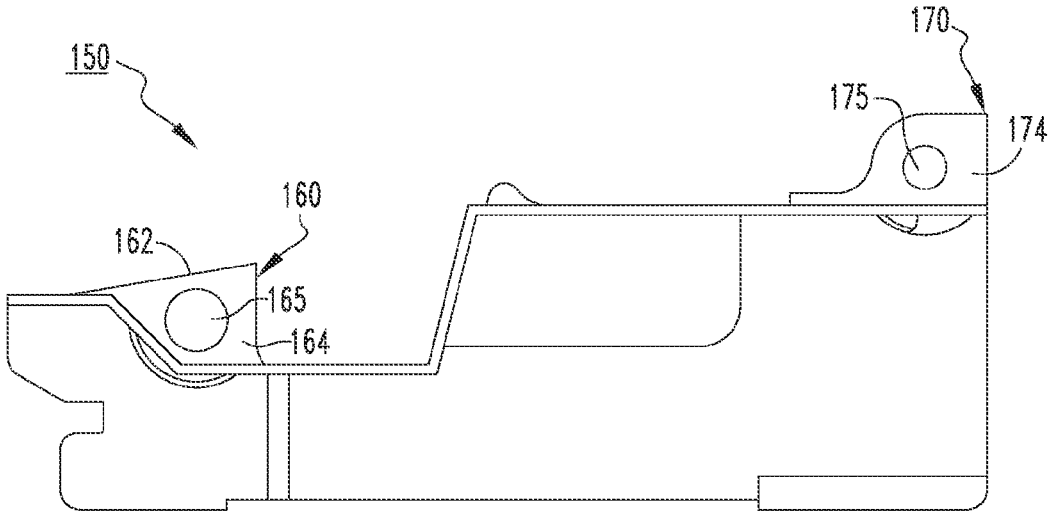
FIG. 7 is an elevation view of the other base member of the housing assembly of FIG. 4.

More specifically, and with reference to FIG. 4, the first base member 110 includes a number of coupling portions 120,130. The second base member 150 includes a corresponding number of coupling portions 160,170 that are aligned with the coupling portions 120,130. The coupling portions 120,130 include generally planar surfaces 122,132. The coupling portions 160,170 include corresponding generally planar surfaces 164,174 (see also FIG. 7) that have respective thru holes 165,175. When assembled, each of the surfaces 122,132 is generally flush with a corresponding one of the surfaces 164,174, thereby providing a secure engagement between the first base member 110 and the second base member 150. Additionally, the coupling members 103,104 (FIG. 3) each extend through the respective surfaces 122, 132, the respective thru holes 165,175, and the cover 102 (FIG. 3) in order to secure the cover 102, the first base member 110, and the second base member 150 to one another.

In order to facilitate alignment of the base members 110,150, and also to improve the connection between the base members 110,150, the coupling portions 120,130 each further surfaces 122,132. The posts 124,134 each have a respective thru hole 125,135. Furthermore, the posts 124, 134 each extend into a respective one of the thru holes 165,175. The respective coupling members 103,104 each extend through the respective thru holes 125,135 and the respective thru holes 165,175.

Continuing to refer to FIG. 4, the first base member 110 includes a planar portion 111 that separates the collar 4 (FIG. 2) from the second base member 150. The planar portion 111 includes a planar surface 112 that engages the collar 4 (FIG. 2). The first base member 110 also includes a plurality of other planar surfaces 114,116,118 that likewise engage the collar 4 (FIG. 2). As further described below, the separation of the collar 4 from the second base member 150 (i.e., as a result of the planar portion 111 being located between the collar 4 (FIG. 2) and the second base member 150) advantageously improves the ability of the circuit breaker 2 to withstand the relatively large amounts of torque applied during tightening and loosening of the collar 4 (FIG. 2).

As shown, the planar surfaces 114,116,118 extend from the planar surface 112 away from the second base member 150. Additionally, the coupling portion 120 extends from proximate the planar surface 112 away from the planar surfaces 114,116,118. In order to provide a relatively secure connection between the first base member 110 and the second base member 150 in this region (i.e., proximate the coupling portions 120,160), the coupling portion 160 further includes another planar surface 162 that engages the planar portion 111 and is generally flush therewith. The planar surface 162 is generally parallel to the planar surface 112 (see, for example, FIG. 2). Moreover, the planar surface 164 extends from the planar surface 162 away from the planar portion 111, and is generally perpendicular to the planar surface 162. Accordingly, referring to FIG. 5, it will be appreciated that, in the exemplary orientation, the collar 4 (FIG. 2) is located entirely above the planar portion 111.

Figure 5:
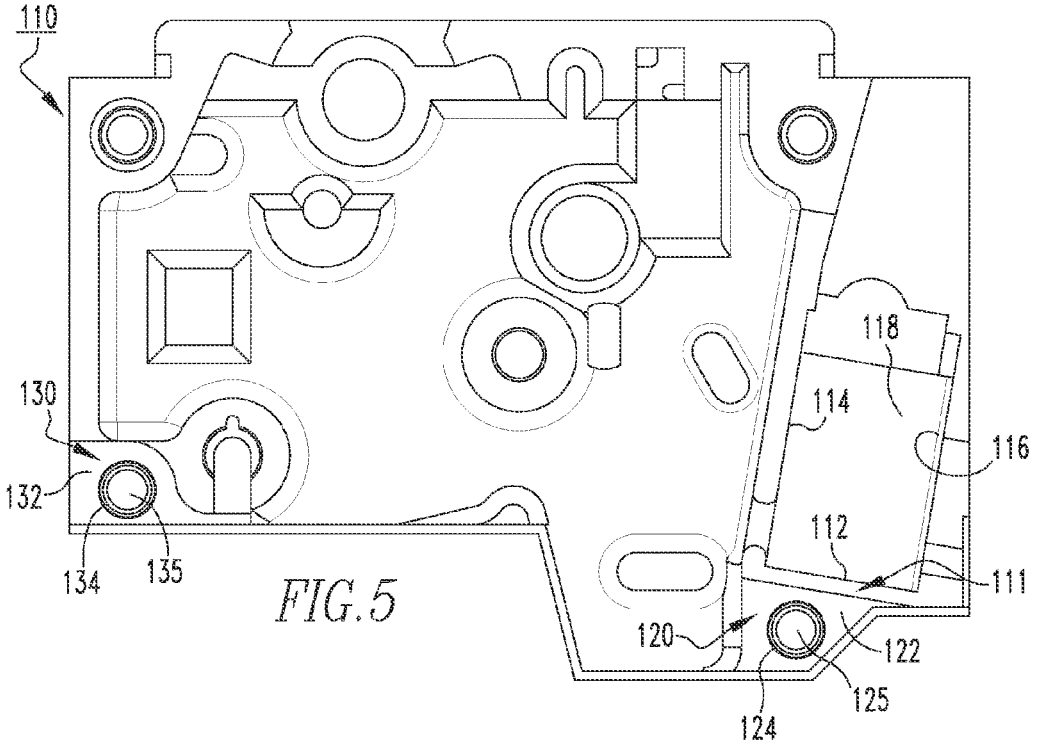
FIG. 5 is an elevation view of a base member of the housing assembly of FIG. 4.
Figure 6:
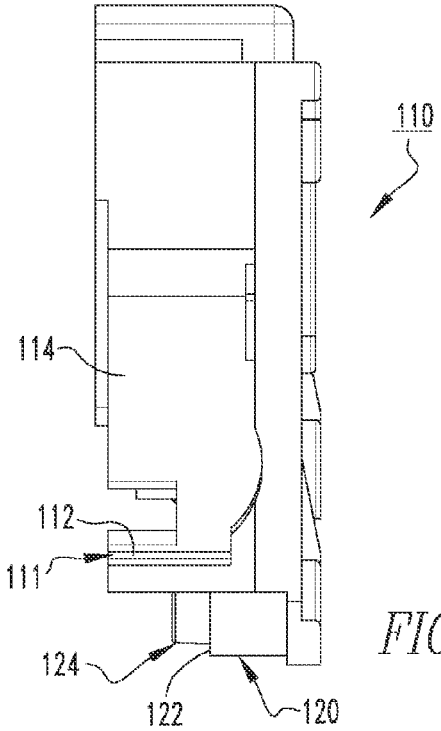
FIG. 6 is an end elevation view of the base member of FIG. 5.

The post 124 is located generally perpendicular to the surface 122 of the coupling portion 120, as shown in FIG. 6. It will likewise be appreciated that the post 134 is located generally perpendicular to the surface 132, as shown in FIGS. 4 and 5. This advantageously assists in preventing lateral movement of the base members 110,150 with respect to one another and also assists with alignment of the base members 110,150 during assembly.

As mentioned, the housing assembly 100 has a composite nature. More specifically, the first base member 110 is made from a first material and the second base member 150 is made from a second, different material. A non-limiting example of the first material of the first base member 110 is a suitable glass polyester. One example is Rosite® 3550D, which is marketed by Industrial Dielectrics, Inc. of Noblesville, Ind. A non-limiting example of the second material of the second base member 150 is a suitable cellulose filled melamine formaldehyde. The first material of the first base member 110 is less brittle than the second material of the second base member 150. That is, the first material of the first base member 110 is relatively strong and is thus able to effectively withstand the relatively large amounts of torque that are caused by the collar 4 (FIG. 2) being tightened and loosened without cracking or otherwise deforming. Additionally, the second material of the second base member 150 possesses the necessary gassing characteristics to effectively extinguish the arc during current interruption.

The disclosed housing assembly 100 thus addresses the deficiencies of prior art housing assemblies (not shown), which commonly suffer from at least one of the drawbacks of not being able to effectively extinguish the arc, or, not being able to withstand tightening and loosening of a collar. That is, the composite nature of the disclosed housing assembly 100 allows the arc to be extinguished and withstands torqueing. More specifically, the surfaces 112,114, 116,118 that engage the collar 4 (FIG. 2) are spaced from the second base member 150. Thus, when the collar 4 (FIG. 2) is tightened or loosened, the resulting torque on the housing assembly 100 is substantially absorbed by the first base member 110 and not the second base member 150. Because of the material nature of the first base member 110 (i.e., relatively strong and less brittle), the first base member 110 advantageously does not crack or deform, which cannot be said for prior art single unitary base members (not shown) that are made entirely from a material chosen primarily because of its ability to effectively extinguish the arc caused by current interruption.

Additionally, the arc chute 6 (FIG. 2) is substantially contained in the second base member 150. Referring again to FIG. 2, the second base member 150 includes a number of walls 152,154,156,158. The walls 152,154 are opposite and spaced from one another. The the walls 152,154 to one another. Together, the walls 152,154,156,158 contain the arc chute 6. Because this region (i.e., within the walls 152,154, 156,158) is where arcing occurs, the material nature of the second base member 150 (i.e., relatively good gassing characteristics) advantageously allows the second base member 150 to effectively extinguish the arc. Prior art single unitary base members (not shown) made entirely from a material chosen primarily because of its ability to withstand tightening and loosening of a collar, on the other hand, do not have the requisite gassing characteristics to effectively extinguish the arc. Thus, the composite housing assembly 100, unlike prior art housing assemblies (not shown) which include a single unitary base member (not shown), is advantageously able to effectively withstand tightening and loosening of the collar 4 (as described above) as well as extinguish the arc caused by current interruption. This improves durability and life expectancy of the circuit breaker 2.

Accordingly, it will be appreciated that the disclosed concept provides for an improved (e.g., without limitation, more durable, longer lasting) electrical switching apparatus 2 and housing assembly 100 therefor, which among other benefits, allows the electrical switching apparatus 2 to withstand the relatively large amounts of torque caused by tightening and loosening of a collar 4, while simultaneously effectively extinguishing the arc caused by current interruption.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A housing assembly for an electrical switching apparatus, said electrical switching apparatus comprising an arc chute and a collar, said housing assembly comprising:

a plurality of housing members comprising a first base member and a second base member, said first base member being structured to receive said collar, said second base member being coupled to said first base member and being structured to receive said are chute, wherein said first base member is made from a first material and said second base member is made from a second, different material; wherein said first base member comprises a plurality of planar surfaces each structured to engage said collar; and wherein each of said planar surfaces is spaced from said second base member.

2. The housing assembly of claim 1 wherein said plurality of housing members further comprises a cover and at least one coupling member; and wherein said at least one coupling member extends through said cover, said first base member, and said second base member in order to couple said cover to said first base member and said second base member.

3. The housing assembly of claim 2 wherein said first base member comprises at least one coupling portion comprising a surface; wherein said second base member comprises at least one coupling portion comprising a surface having a thru hole; wherein said surface of said first base member is generally flush with said surface of said second base member; and wherein said at least one coupling member extends through said surface of said first base member and through the thru hole of said second base member in order to couple said first base member to said second base member.

4. The housing assembly of claim 3 wherein said at least one coupling portion of said first base member further comprises a cylindrical-shaped post extending from said surface of said at least one coupling portion of said first base member and being generally perpendicular with respect thereto; wherein said post has a thru hole; wherein said post extends into the thru hole of said second base member; and wherein said at least one coupling member extends through the thru hole of said post.

5. The housing assembly of claim 4 wherein said at least one coupling portion of said first base member is a plurality of coupling portions; wherein said at least one coupling portion of said second base member is another plurality of coupling portions; and wherein said at least one coupling member is a plurality of coupling members.

6. The housing assembly of claim 1 wherein said second base member comprises a first wall, a second wall, a third wall, and a fourth wall; wherein said first wall is disposed opposite said second wall and is spaced therefrom; wherein said third wall is disposed opposite said fourth wall and is spaced therefrom; wherein said third wall and said fourth wall each connect said first wall to said second wall; and wherein said first wall, said second wall, said third wall, and said fourth wall are structured to contain said arc chute.

7. The housing assembly of claim 1 wherein said plurality of planar surfaces comprises a first planar surface, a second planar surface, a third planar surface, and a fourth planar surface; wherein said second planar surface, said third planar surface, and said fourth planar surface extend from said first planar surface away from said second base member; wherein said second base member comprises a coupling portion comprising a fifth planar surface and a sixth planar surface; wherein said fifth planar surface is disposed parallel to said first planar surface; wherein said sixth planar surface is disposed perpendicular to said fifth planar surface; wherein said first base member further comprises another coupling portion extending from proximate said first planar surface away from said second planar surface, said third planar surface, and said fourth planar surface; wherein said another coupling portion comprises a seventh planar surface generally flush with said sixth planar surface; and wherein said number of housing members further comprises a coupling member extending through said sixth planar surface and said seventh planar surface in order to couple said second base member to said first base member.

8. The housing assembly of claim 1 wherein said first material is less brittle than said second material.

9. The housing assembly of claim 8 wherein said first material is glass polyester.

10. The housing assembly of claim 8 wherein said second material is cellulose filled melamine formaldehyde.

11. An electrical switching apparatus comprising, an arc chute;

a collar; and a housing assembly comprising:

a plurality of housing members comprising a first base member and a second base member, said first base member receiving said collar, said second base member being coupled to said first base member and receiving said arc chute, wherein said first base member is made from a first material and said second base member is made from a second, different material; wherein said first base member comprises a planar portion engaging said collar and separating said collar from said second base member.

12. The electrical switching apparatus of claim 11 wherein said second base member comprises a coupling portion having a planar surface engaging said planar portion of said first base member and being generally flush therewith.

13. The electrical switching apparatus of claim 12 wherein said coupling portion further has a second planar surface extending from said planar surface away from said planar portion of said first base member; wherein said first base member further comprises another coupling portion having a third planar surface extending from proximate said planar portion and being generally flush with said second planar surface; and wherein said number of housing members further comprises a coupling member extending through said second planar surface and said third planar surface in order to couple said second base member to said first base member.

14. The electrical switching apparatus of claim 11 wherein said first base member comprises a plurality of planar surfaces each engaging said collar and being spaced from said second base member.

15. The electrical switching apparatus of claim 11 wherein said second base member comprises a first wall, a second wall, a third wall, and a fourth wall; wherein said first wall is disposed opposite said second wall and is spaced therefrom; wherein said third wall is disposed opposite said fourth wall and is spaced therefrom; wherein said third wall and said fourth wall each connect said first wall to said second wall; and wherein said first wall, said second wall, said third wall, and said fourth wall each contain said arc chute.

16. The electrical switching apparatus of claim 15 wherein said arc chute does not engage said first base member.

17. The electrical switching apparatus of claim 11 wherein said first material is glass polyester; wherein said second material is cellulose filled melamine formaldehyde; and wherein said first material is less brittle than said second material.

18. The electrical switching apparatus of claim 11 wherein said electrical switching apparatus is a miniature circuit breaker.

19. A housing assembly for an electrical switching apparatus, said electrical switching apparatus comprising an arc chute and a collar, said housing assembly comprising:

a plurality of housing members comprising a first base member and a second base member, said first base member being structured to receive said collar, said second base member being coupled to said first base member and being structured to receive said arc chute, wherein said first base member is made from a first material and said second base member is made from a second, different material; wherein said first base member comprises a number of surfaces each structured to engage said collar; and wherein each of said surfaces is spaced from said second base member.

* * * * *